United States Patent [19]

Welborn

[11] Patent Number: 4,638,873

[45] Date of Patent: Jan. 27, 1987

[54] DIRECTION AND ANGLE MAINTENANCE TOOL AND METHOD FOR ADJUSTING AND MAINTAINING THE ANGLE OF DEVIATION OF A DIRECTIONALLY DRILLED BOREHOLE

[76] Inventor: Austin E. Welborn, Rte. 1, Box 96A, Greensburg, La. 70441

[21] Appl. No.: 613,360

[22] Filed: May 23, 1984

[51] Int. Cl.[4] ..... E21B 7/04; E21B 7/08

[52] U.S. Cl. ..... 175/73; 175/76; 175/325

[58] Field of Search ..... 175/45, 61, 73, 74, 175/325, 76, 82, 83, 346; 308/4 A; 166/241

[56] References Cited

U.S. PATENT DOCUMENTS

| | | | |
|---|---|---|---|
| 3,062,303 | 11/1962 | Schultz | 175/61 |
| 3,092,188 | 6/1963 | Farris et al. | 175/61 X |
| 3,650,338 | 3/1972 | McNeely, Jr. | 175/61 |
| 3,825,081 | 6/1974 | McMahon | 175/73 |
| 4,220,213 | 9/1980 | Hamilton | 175/61 |
| 4,305,474 | 12/1981 | Farris et al. | 175/73 |

FOREIGN PATENT DOCUMENTS

| | | | |
|---|---|---|---|
| M 15070 | 9/1956 | Fed. Rep. of Germany | 308/4 A |

*Primary Examiner*—James A. Leppink
*Assistant Examiner*—Matthew Smith
*Attorney, Agent, or Firm*—William David Kiesel; Robert C. Tucker; J. Bradley Overton

[57] ABSTRACT

A direction and angle maintenance tool and a method for using same are provided for drilling directionally oriented boreholes. The tool generally comprises a mandrel and a sleeve, which is rotatably attachable around the mandrel. The mandrel has a longitudinal bore and is attachable at its upper end to a rotary drill string and at its lower end to a rotary drill bit sub which is attached to a rotary drill bit. The sleeve has an eccentric longitudinal bore, forming a heavy, or weighted, side of the sleeve. A gauge insert is provided which is longitudinally attachable to the weighted side of the sleeve. By varying the size of the insert, the angle of deviation of a directionally drilled borehole may be maintained or adjusted. A self-adjusting blade may be added in order to aid in maintaining a desired angle of deviation or to induce a desired change of direction.

15 Claims, 6 Drawing Figures

DIRECTION AND ANGLE MAINTENANCE TOOL AND METHOD FOR ADJUSTING AND MAINTAINING THE ANGLE OF DEVIATION OF A DIRECTIONALLY DRILLED BOREHOLE

BACKGROUND OF THE INFORMATION

This invention relates generally to rotary drilling equipment and methods and, more particularly, to devices and methods for drilling a borehole at an angular deviation from vertical.

In the oil and gas industry, it is often necessary to drill a well at an angle from vertical. Due to the flexibility of long runs of drill pipe (drill string), deviations from vertical of very large magnitudes may be obtained. However, because of the same flexibility, specific angular deviations are difficult and costly to maintain. It is also difficult as well as expensive to vary the angular deviation at different points in the drilling operation.

In directional drilling operations, a well is initially drilled to a specific depth in order to establish a desired angular deviation from vertical. This initial step is accomplished by means well known in the art. Once a desired deviation is established, it may be continued to a target area, or it may be varied. Varied deviations occur when the driller must steer the drill string around a formation and then return to vertical or to some other desired direction (commonly called an s-type hole). Once a deviation is established, the side of the borehole nearest to a true vertical bore is termed the "low" side of the hole and is used as a reference point.

A common problem encountered in directional drilling is the variance from the desired deviation caused by the rotational forces exerted on the drill bit. This phenomenon is known as "walk". The drill bit will generally tend to walk to the right of the low side of the hole, although other directions of walk are possible depending on the circumstances. When a directional well is initialized, the hole is often started to the left to compensate for right hand walk during the process of establishing the desired deviation. Various devices have been designed to help eliminate undesired deviation while guiding the bit in a desired direction:

| Patentee | U.S. Pat. No. | Date Issued | Title |
|---|---|---|---|
| Baker, et al | 4,416,339 | 11/22/83 | Bit Guidance Device Method |
| Jeter | 4,319,649 | 3/16/82 | Stabilizer |
| Farris, et al | 4,305,474 | 12/15/81 | Thrust Acterated Drill Guidance Device |
| Hamilton | 4,220,213 | 9/02/80 | Method and Apparatus for Self Orienting a Drill String While Drilling a Well Bore |
| Nixon, Jr. | 4,185,704 | 1/29/80 | Directional Drilling Apparatus |
| McMahon | 3,825,081 | 7/23/74 | Apparatus for Slant Hole Directional Drilling |
| Garrison, et al | 3,561,549 | 2/09/71 | Slant Drilling Tools for Oil Wells |
| Farris, et al | 3,092,188 | 6/04/63 | Directional Drilling Tool |
| Page, et al | 2,891,769 | 6/23/59 | Directional Drilling Tool |

Simplicity in design and application is a key factor in the success of such designs. Several of the above listed designs require pistons actuated by hydraulic pressure or other complicated mechanical actuation. Other designs can only be used with a down hole motor rather than conventional rotary drilling equipment. Such designs are therefore expensive, prone to mechanical failure and restricted in their applications.

A device which is simple in mechanical operation, self-actuating, self-orienting and which attempts to correct undesired deviation is illustrated by the Hamilton patent listed above. The Hamilton device comprises a longitudinally eccentric tubular member which attaches rotatably around a mandrel within the drill string. A projection is provided, extending radially from the tubular member to a greater extent than the diameter of the drill bit. When the device is placed between the drill string and the drill bit, the heavier portion of the tubular member theoretically rotates to the low side of the borehole, positioning the projection such that it urges the drill bit in an opposite direction from that to which the bit has a tendency to walk.

One problem which occurs with the Hamilton device results from the fact that all boreholes do not retain a diameter greater than that of the drill bit. Many formations tend to collapse toward the center of the borehole, causing the diameter of the hole to shrink. When this occurs, the Hamilton device will become stuck in the hole, losing its self-orienting feature and necessitating expensive recovery operations. This sticking is due in part to the fact that the projection in Hamilton extends past the diameter of the drill bit. The general sectional configuration of the Hamilton device does not promote smooth rotation within the confines of the borehole. Also, the Hamilton device cannot be used to intentionally change the deviation of the hole.

SUMMARY OF THE INVENTION

Therefore, it is an object of this invention to provide a device which may be used to directionally drill a borehole, the device being self-orienting and capable of varying or maintaining the angle of deviation of the borehole.

It is another object of this invention to provide such a device which is capable of preventing and correcting undesired deviation while operating in a borehole with varying diameters.

It is a further object of this invention to provide such a device which has a minimum number of moving parts, requires little maintenance and operates smoothly within the borehole.

Still another object of this invention is to provide a method for directionally drilling a borehole by which the angle of deviation may be varied or maintained, while preventing undesired deviation.

Still further objects and advantages of this invention shall become apparent from the ensuing descriptions of the invention.

Accordingly, a direction and angle maintenance tool and a method using same are provided for drilling directionally oriented boreholes. The tool comprises a mandrel and a sleeve, which is rotatably attachable around the mandrel. The mandrel has longitudinal bore and is attachable at its upper end to a rotary drill string and at its lower end to a rotary drill bit sub which is attached to a rotary drill bit. The sleeve has an eccentric longitudinal bore, forming a heavy, or weighted, side of the sleeve. A gauge insert is provided which is longitudinally attachable to the weighted side of the sleeve. By varying the size of the insert, the angle of deviation of a directionally drilled borehole may be maintained or adjusted. A self-adjusting blade may be added in order to aid in maintaining a desired angle of deviation or to induce a desired change of direction.

DESCRIPTION OF PREFERRED EMBODIMENTS OF THE INVENTION

Figure 1:
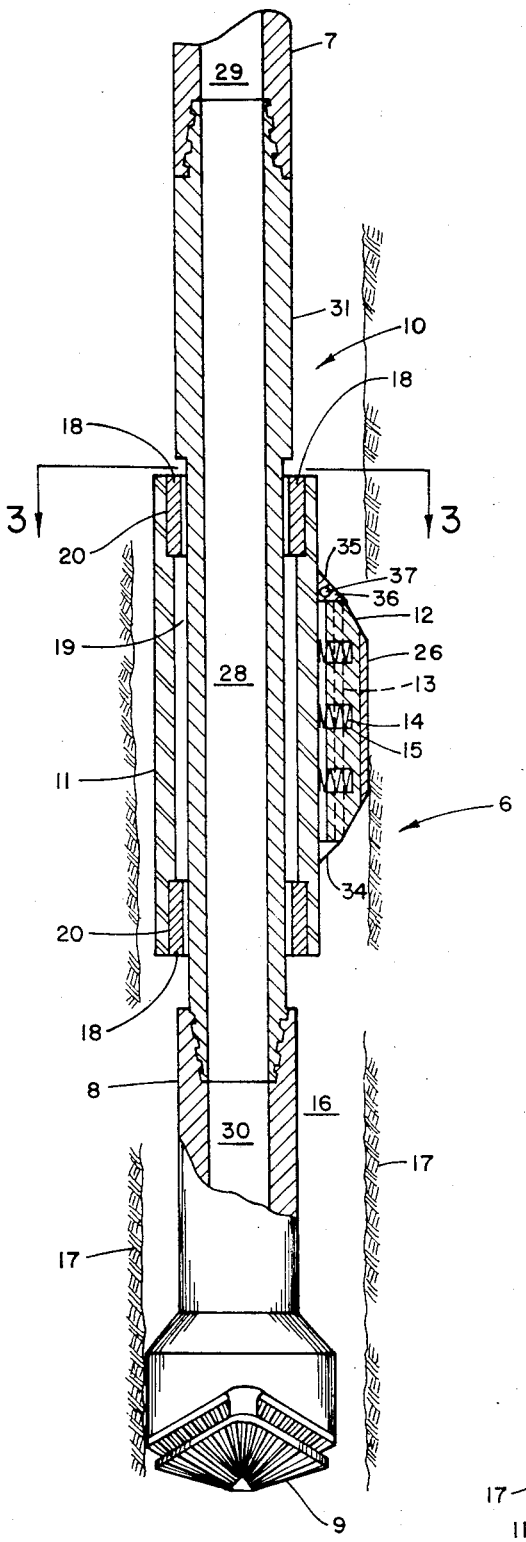
FIG. 1 illustrates a sectional side view of a preferred embodiment of the invention in position within a borehole.

A preferred embodiment of the direction and angle maintenance tool 6 is shown in FIG. 1. The tool 6 is shown in place, connected to the drill string 7 at its upper end and a rotary bit sub 8 at its lower end. The rotary bit sub 8 is connected to a drill bit 9. The assembly operates within a borehole 16 which is drilled through various formations 17.

Figure 2:
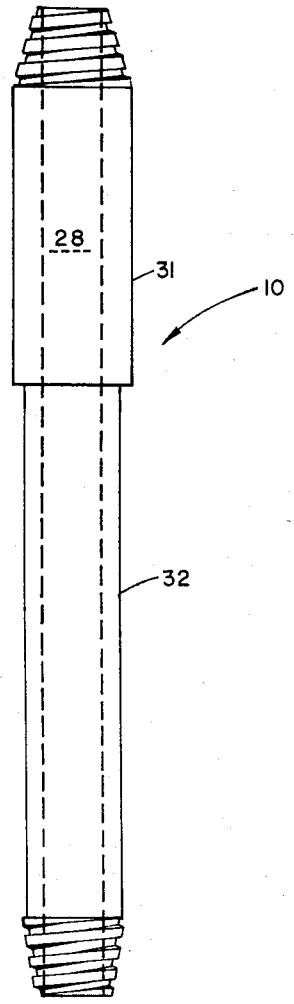
FIG. 2 is a side view of the mandrel of the invention.

The basic tool 6 comprises a mandrel 10 and a sleeve 11. The mandrel 10 has a longitudinal bore 28 alignable with the drill string bore 29 and sub bore 30. The mandrel comprises an upper section 31 having an outside diameter approximately equal to that of the drill string 7 and a lower section 32 having a reduced outside diameter, as shown in FIG. 2. The mandrel is threaded on each end so as to matingly couple to the drill string 7 and bit sub 8.

Figure 3:
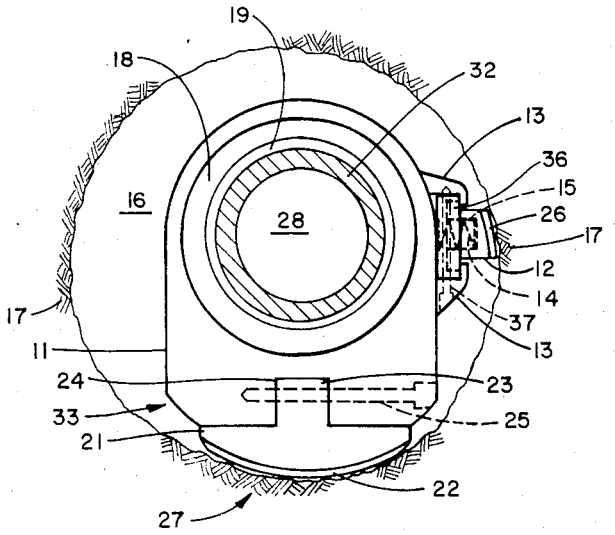
FIG. 3 illustrates a top view of a preferred emobodiment of the invention taken along line 2—2 of FIG. 1.
Figure 4:
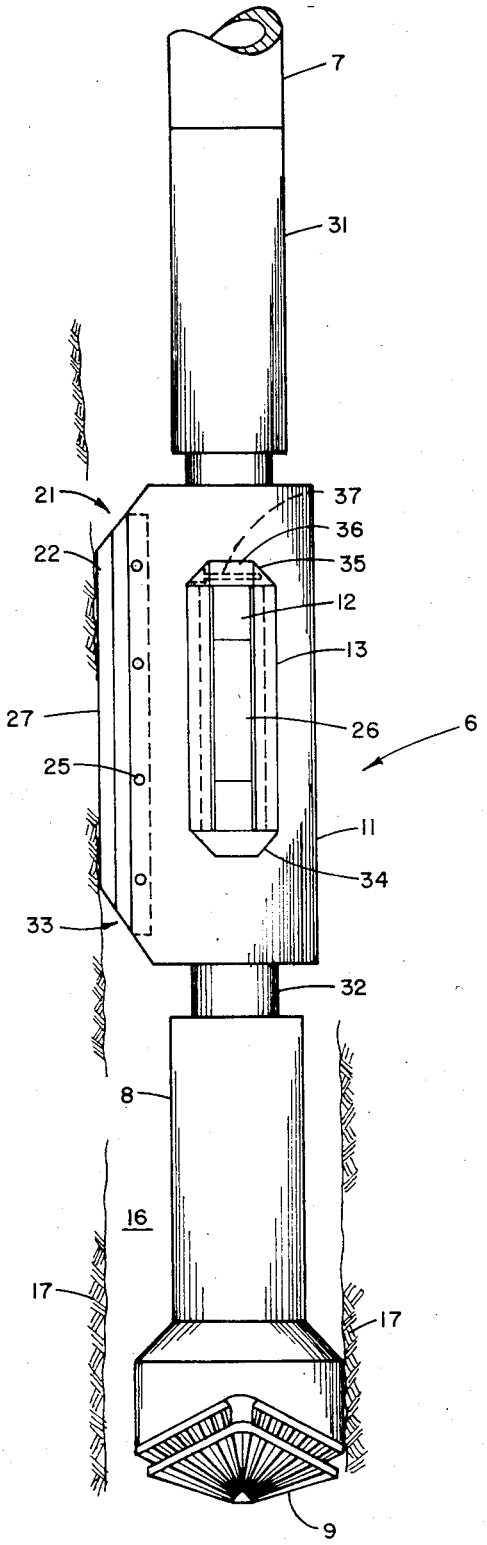
FIG. 4 is a side view of a preferred embodiment of the invention from the perspective of line 4—4 of FIG. 3.
Figure 5:
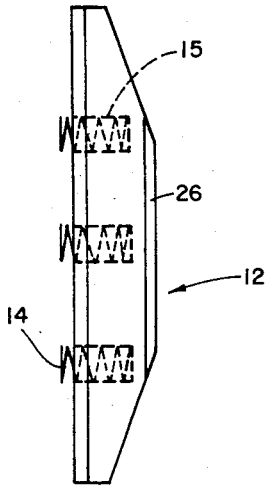
FIG. 5 is a side view of the blade of the invention.
Figure 6:
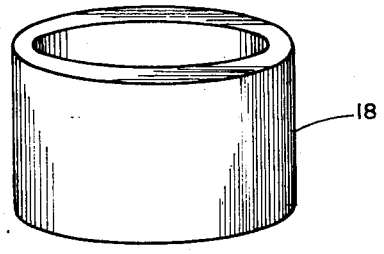
FIG. 6 is a perspective view of a friction reducing insert of the invention.

The sleeve 11, shown in FIGS. 1, 3 and 4, is provided with an eccentric bore 19, resulting in the sleeve 11 having a weighted, or heavy, side 33. A gauge insert 21 is provided having a projection 23 which is matingly attachable in slot 24, as shown in FIG. 3. The gauge insert 21 is held fixedly in slot 24 by bolts 25. In a preferred embodiment, the gauge insert 21 is provided with a hardened outer wearing surface 22. In another preferred embodiment, the thickness of the gauge insert 21 varies according to the desired angular deviation of the hole. The sleeve bore 19 is of a diameter larger than the diameter of the lower section 32 of the mandrel 10, allowing for relative rotation between the mandrel 10 and the sleeve 11. In a preferred embodiment the sleeve 11 is provided with a counterbore 20 at either end, and friction reducing inserts 18 (shown in perspective in FIG. 6) are pressed into the ends of the sleeve 11. The inserts 18 have an inside diameter slightly smaller than that of the sleeve 11, but larger than that of the lower section 32 of the mandrel 10. Thus, the inserts 18 prevent contact between the sleeve 11 and the mandrel 10 within the sleeve bore 19 at points between the two inserts 18.

In order to correct the tendency to walk, a self-adjusting blade 12 is provided. The blade 12 is circumferentially offset from the weighted side 33, and is positioned so as to urge the tool 6 in a direction opposite to the direction of walk. The blade 12 is held in place by blade retainer means 13. The lower end 34 of blade retainer means 34 is sealed by welding or other means so as to hold the blade 12 in place. The upper end 35 of blade retainer means 13 is provided with a removable blade retainer cap 36 and held in place by bolt 37, such that the blade 12 may be changed as desired. Contact against the formation 17 is maintained by a blade extension means 14, preferably three coil springs, positioned in blade recesses 15 compressibly between the blade 12 and the sleeve 11. By changing the springs 14, the radial force exerted by the blade 12 against the formation 17 may be varied. Also, should the diameter of the borehole 16 vary, the blade 12 will maintain contact with the formation, while retracting or extending according to the borehole diameter. In a preferred embodiment, the blade 12 is provided with a hardened outer wearing surface 26. As shown in FIG. 3, it is also perferred that the blade 12 extend radially from the center of the sleeve bore 19. The outer surface 26 of the blade 12 should be curved, with the center of the arc located at the center of the borehole 16. This configuration allows for maximum application of radial force and minimal frictional resistance between the blade 12 and the formation 17 as the sleeve 11 positions itself in the hole 16.

It is preferred that the tool 6 be constructed of high strength steel, such as 41–40 steel.

OPERATION

In order to maintain a desired angular deviation in a borehole 16, the tool 6 is attached between the rotary drill string 7 and the rotary bit sub 8. The tool 6 is operated by lowering it into the borehole 16 and drilling normally. As the tool 6 is lowered into the borehole 16, the weighted side 33 of the sleeve 11 will rotate and gravitationally seek the low side 27 of the borehole 16. This self-orientation will generally occur in holes with a deviation from vertical of at least twelve degrees. The gauge insert 21 will therefore be oriented at the low side 27 of the hole 16 and the blade 12 (if used) will be oriented in the direction of walk.

Before the tool 6 is attached to the drill string 7, a gauge insert 21 is chosen and attached in the gauge insert slot 24 using bolts 25. A thickness of gauge insert 21 is chosen which will achieve the desired result. Depending upon the thickness chosen, the angle of deviation of the well bore may be held constant or changed. By reducing the thickness, or gauge, of the insert the angle of deviation can be reduced. By increasing the gauge, the angle of deviation can be controlled. This can be accomplished at varying rates of change, according to the gauge chosen.

If the drill bit is walking, the self-adjusting blade 12 may be attached to the sleeve 11. Springs 14 are chosen with a tension which will counteract the walk. The blade 12 is attached to the same side of the sleeve 11 as the direction of walk, thus exerting pressure in the opposite direction. Should course correction be required to counteract excessive walk, springs 14 are chosen which will induce walk in the opposite direction.

For example, suppose that it is determined that the borehole 16 has deviated too far to the right, but otherwise the angular deviation of the hole is as desired. A gauge insert 21 is selected which will hold the desired angular deviation. A blade 12 is positioned on the right side of the sleeve, and springs are installed which will force the bit 9 to the left, thus walking the bit 9 back toward the desired course. The self-adjusting blade 12 is designed such that it will not become stuck in the hole when the formation changes radically. The springs 14 are of such a tension so as to allow the blade to retract and thus allow the tool 6 to slide freely in the hole as various hole diameters are encountered. When the tool 6 is back on course, a set of springs 14 is installed which will hold the desired deviation and counteract the tendency to walk to the right.

As can be seen, the invention embodied herein may be employed to change the deviation from vertical of a directionally drilled borehole or to maintain a desired deviation. The tendency of the drill bit to walk can be countered and correctional adjustments applied. Furthermore, the tool will not become stuck when the borehole diameter is constricted. Of course, there are many other alternate embodiments not specifically described, but which are intended to be included within the scope of this invention, as defined by the following claims.

I claim:

1. A direction and angle maintenance tool for drilling directionally oriented boreholes, comprising:

(a) a mandrel having a longintudinal bore, an upper end attachable to a rotary drill pipe, a lower end attachable to a rotary drill bit sub and a reduced diameter section;

(b) a sleeve, rotatably attachable around said reduced diameter section of said mandrel, said sleeve having an eccentric longitudinal bore forming a weighted side, and a gauge insert which is longitudinally and fixedly attached to said weighted side said longitudinal bore being of sufficient diameter to allow free relative rotation between said mandrel and said sleeve; and (c) a means, attachable to said sleeve and said insert, for longitudinally and fixedly attaching said gauge insert to said sleeve on said weighted side.

2. A direction and angle maintenance tool as described in claim 1, wherein said weighted side of said sleeve is provided with a longitudinal slot and said gauge insert is provided with a projection which is matinlgy and fixedly attachable in said slot.

3. A direction and angle maintenance tool as described in claim 2, wherein said gauge insert is provided with a hardened outer wearing surface.

4. A direction and angle maintenance tool as described in claim 3, wherein said eccentric longitudinal bore is provided with counterbores of each end concentric with said longitudinal bore and wherein said sleeve is provided with cylindrical friction reducing inserts, matingly and fixedly attached within said counterbores, each said insert having an internal diameter slightly smaller than that of said eccentric longitudinal bore.

5. A direction and angle maintenance tool as described in claim 1, further comprising:

(c) a self-adjusting blade, attachable to said sleeve, projecting radially outward from said sleeve at a point circumferentially offset from said weighted side of said sleeve;

(d) a blade extension means, positioned between said blade and said sleeve, for urging said blade against the wall of said borehole; and (e) a blade retainer means, fixedly attachable to said sleeve, for securing said blade to said sleeve while allowing movement of said blade radially of said sleeve.

6. A direction and angle maintenance tool as described in claim 5, wherein said blade extension means comprises a plurality of coil springs compressibly insertable between said blade and said sleeve.

7. A direction and angle maintenance tool as described in claim 6, wherein said springs are of such tension as to maintain a desired lateral force between said blade and the wall of said borehole, while allowing said blade to retract or extend as the diameter of said borehole varies.

8. A direction and angle maintenance tool as described in claim 7, wherein said blade is provided with a plurality of recesses into which said springs are matingly insertable.

9. A direction and angle maintenance tool as described in claim 8, wherein said blade is provided with a hardened outer wearing surface.

10. A direction and angle maintenance tool as described in claim 9, wherein said blade projects radially outward from the center of said eccentric longitudinal bore, and said outer surface of said blade curved, with the curvature centered at the center of the said borehole.

11. A direction and angle maintenance tool as described in claim 10, wherein the thickness of said gauge insert varies according to the desired angular deviation of said borehole.

12. A direction and angle maintenance tool as described in claim 11, wherein said weighted side of said sleeve is provided with a longitudinal slot and said gauge insert is provided with a projection which is matingly and fixedly attachable in said slot.

13. A direction and angle maintenance tool as described in claim 13, wherein said gauge insert is provided with a hardened outer wearing surface.

14. A direction and angle maintenance tool as described in claim 13, wherein said eccentric longitudinal bore is provided with counterbores of each end concentric with said longitudinal bore and wherein said sleeve is provided with cylindrical friction reducing inserts, matingly and fixedly attached within said counterbores, each said insert having an internal diameter slightly smaller than that of said eccentric longitudinal bore.

15. A method for adjusting and maintaining the angle of deviation of a directionally drilled borehole, comprising the steps of:

(a) attaching between a drill string and a drill bit a direction and angle maintenance tool comprising:

(i) a mandrel having a longintudinal bore, an upper end attachable to a rotary drill pips, a lower end attachable to a rotary drill bit sub and a reduced diameter section; and (ii) a sleeve, rotatably attachable around said reduced diameter section of said mandrel, said sleeve having an eccentric longitudinal bore forming a weighted side, and a gauge insert which is longitudinally and fixedly attachable to said weighted side, said longitudinal bore being of sufficient diameter to allow free relative rotation between said mandrel and said sleeve, (b) attaching to said sleeve on said weighted side said gauge insert of a particular thickness so as to achieve a desired deviation from vertical;

(c) lowering said drill string, said tool and said bit into said borehole; and (d) rotating said drillstring relative to said tool and drilling to a desired depth at said desired deviation from vertical.

* * * * *